United States Patent [19]

Bowling et al.

[11] Patent Number: 5,033,115

[45] Date of Patent: Jul. 23, 1991

[54] PROTECTIVE GARMENT

[76] Inventors: Patricia J. Bowling, 3202 W. Charleston Blvd., Las Vegas, 89102; Scott Burgess, P.O. Box 3050, Incline Village, Nev. 89450

[21] Appl. No.: 359,165

[22] Filed: May 31, 1989

[51] Int. Cl.[5] ..... A41D 13/04

[52] U.S. Cl. ..... 2/51; 2/48; 2/49 R; 2/DIG. 7

[58] Field of Search ..... 2/9, 46, 48, 49 R, 50, 2/51, 52, DIG. 7; D29/1, 8, 9

[56] References Cited

U.S. PATENT DOCUMENTS

| | | | |
|---|---|---|---|
| D. 193,132 | 7/1962 | Rhoads | 2/DIG. 7 |
| D. 208,527 | 9/1967 | Grengg | 2/48 |
| 969,491 | 9/1910 | Payne | 2/50 |
| 986,728 | 3/1911 | Lee | 2/50 |
| 1,560,997 | 11/1925 | Kelly | 2/48 |
| 2,056,753 | 10/1936 | Wagner | D29/9 |
| 2,374,643 | 5/1945 | Boettcher | 2/DIG. 7 |
| 2,492,003 | 12/1949 | Peckinpaugh | 2/51 |
| 2,987,730 | 6/1961 | Walker | 2/50 |
| 3,045,815 | 7/1962 | Abildgaard | 2/DIG. 7 |
| 3,098,233 | 7/1963 | Hoagland | D29/9 |
| 3,736,595 | 6/1973 | Siegmann | 2/DIG. 7 |
| 3,823,418 | 7/1974 | Piper | 2/9 |
| 3,977,025 | 8/1976 | Horan | 2/DIG. 7 |
| 4,290,148 | 9/1981 | Roberts | 2/51 |
| 4,569,086 | 2/1986 | Takefman | 2/49 R |
| 4,766,608 | 8/1988 | Cusick | 2/DIG. 7 |

FOREIGN PATENT DOCUMENTS

| | | | |
|---|---|---|---|
| 1144702 | 4/1983 | Canada | 2/51 |
| 2189979 | 11/1987 | United Kingdom | 2/48 |

*Primary Examiner*—Werner H. Schroeder
*Assistant Examiner*—Diana L. Biefeld
*Attorney, Agent, or Firm*—Polster, Polster and Lucchesi

[57] ABSTRACT

A protective garment for emergency personnel includes a body in the form of a surgical gown, an over-the-shoulder tab for extending behind the wearer's neck and holding the protective garment in place, attached latex gloves, and an attached face mask. The attached face mask includes goggles and a neck- and mouth-protector in the form of an extended surgical mask.

9 Claims, 3 Drawing Sheets

PROTECTIVE GARMENT

BACKGROUND OF THE INVENTION

This invention relates generally to protective garments and in particular to protective gowns worn by emergency medical personnel for use in treating trauma patients under emergency situations. Such personnel include, for example, paramedics treating patients at accident sites and emergency room personnel.

Hospital gowns are typically designed for one of two uses—either as a sterile gown for use in the operating room or as a non-sterile patient gown. These gowns, especially the sterile surgical gowns, which are worn with face masks and gloves, are worn by physicians and nurses for the protection of the patient, to avoid infecting the patient with any germs the physicians or nurses may be carrying or with germs from another patient. The gowns are maintained sterile and are donned with the aid of other medical personnel in such a way as to maintain a "sterile field" around the patient in the operating room. The ties of such gowns typically extend around the waist of the wearer and are attached at the front or rear by either a sterile or non-sterile assistant. The function of sterile gowns is thus to prevent cross-contamination from patient to patient or from medical personnel to patient. Typical sterile gowns and the manner of using them are described, for example in Aronica, U.S. Pat. No. 4,370,782 and in Reynolds, U.S. Pat. No. 4,395,782. Such gowns are typically made of a disposable non-woven fabric such as the material described in LaFitte et al, U.S. Pat. No. 4,113,911.

In the operating room, medical personnel also don sterile gloves and masks for the same purposes as the gowns. The gloves are typically made of latex or natural rubber. They are put on, after gowning, either by a closed gloving technique or with assistance from another member of the sterile team.

The masks are typically made of a non-woven filter material. They are typically not formed to the wearer's face, and they are pleated to prevent them from becoming saturated with moisture from the wearer's breath and being drawn into the wearer's mouth. The masks are held by ties behind the wearer's head. Masks are non-sterile items and must be donned prior to gowning with the sterile gown. In a non-sterile setting, the gloves and mask are put on at the wearer's leisure.

After an operation, the gowns, gloves, and masks are removed and disposed of before bacteria from the patient can be transferred to other patients directly or indirectly.

Non-sterile gowns worn by patients, by those visiting patients, and by housekeeping personnel perform a similar function of preventing cross-contamination of patients, although the gowns are not as elaborate and no attempt is made to maintain a sterile field around the patient. Typically, such gowns are tied at the waist behind the wearer. Such gowns may be donned at leisure and provide only limited protection against the spread of infection.

Emergency personnel frequently do not use gowns of any sort, because of the time required for donning and removing gowns, and because in a trauma situation the patient is not in a sterile field where contamination of the patient by the attending personnel is the primary consideration.

With the rapid increase of cases of highly infectious diseases, such as AIDS and hepatitis, the medical field has become increasingly concerned not only with protecting the patient, but in protecting the health care provider from a patient's infectious disease. This is especially true in emergency situations either in the emergency room of a hospital or at the site of an accident where it is unknown if the patient is carrying the HIV virus or some other infectious disease. In such a situation a gown or garment is required which adequately protects the health care provider and which can be donned and removed so quickly and easily that the health care provider can give prompt attention to the patient.

Presently, there are no such gowns. Neither patient gowns nor surgical gowns are adequate. Other types of protective garments are also not suitable for emergency medical personnel because they either offer too little protection or are too cumbersome and time-consuming to don.

Patient gowns do not provide much protection, and they generally tie in the back so that they are difficult to secure.

Because surgical gowns are designed to protect the patient, not the wearer, they do not provide adequate protection to the wearer. The wearer's neck and eyes are exposed, and there is no seal between the gloves and sleeves to stop body fluids or chemicals present at accident sites from contacting the wearer's skin. Furthermore, gowns made for the sterile operating room are designed to require assistance in donning and provide even less protection if they are not put on properly.

The additional time required to don gloves and mask, and such other protectors as goggles, further delays the giving of care and denies the patient the prompt attention he needs.

SUMMARY OF THE INVENTION

One object of this invention is to provide a protective garment which will protect a health care provider from the infectious diseases of a patient in emergency situations.

Another object of the invention is to provide such a garment which can be quickly donned and removed.

Another object is to provide such a garment which provides better protection than presently available garments.

Another object is to provide such a garment which can be closed securely using only one hand.

Another object is to provide protection to the next patient from any unseen and unknown contamination from the previous patient.

Other objects will be apparent to those skilled in the art in light of the following description and accompanying drawings.

In accordance with one aspect of this invention, generally stated, a protective garment is provided which includes a standard surgical type gown having sleeves and a neck portion, and having a face mask attached to the neck portion of the gown and gloves attached to its sleeves. This arrangement permits the gown, including the face mask and gloves, to be folded and stored as a unit, permits it to be donned rapidly without assistance, and provides substantial protection for the wearer.

The gown body is preferably a standard surgical gown of the type made of or covered by a material which resists absorption of liquid. Such a gown is open down its back, so that the back side of the gown includes two substantially vertical edges which may meet or overlap in the middle of the back.

The face mask includes two sections: a flexible protective covering which is attached to the neck portion of the gown and extends to the bridge of the wearer's nose, and a protective eye shield which is attached to the surgical mask at the bridge of the nose. The flexible covering may be a single unit, or it may be made of separate neck covering and surgical mask. The eye shield preferably has a head band or some other equivalent means of supporting the full face mask such that it will not fall off during the giving of medical attention by the wearer.

The eye shield and surgical mask preferably have sealing means for creating a secure seal around the eyes and at the top of the nose and cheeks to prevent foreign substances from coming into contact with the wearer. The face mask thereby provides greater protection to the wearer from any fluids present at an accident site.

The full face mask is preferably provided with elastic bands on either side of the mask. The elastic bands extend along, and are attached to, the edges of the flexible neck and mouth shield and are attached to the protective eye shield at the sides of the wearer's head. The bands make the face mask better fit wearers of different sizes and give further support for the flexible covering.

In accordance with another aspect of the invention, the gown is provided with a shoulder tab which may be pulled behind the head and neck of the wearer and attached rapidly to the front of the gown. The shoulder tab preferably is permanently attached to the back left shoulder of the garment and has a free end, which is initially detachably secured by hook-and-pile pressure fastener means to the front left of the gown, and which, when detached for donning, comes around the back left of the garment and extends over the right shoulder to be detachably secured to the front right side of the gown above a breast pocket. The shoulder tab closure enables rapid donning and removal of the gown and securely closes the gown.

The gown may further have a waist tab which is permanently secured to one side of the garment and has a free end which the wearer extends around the back at waist level to be secured on the opposite front side so as to hold the garment closed at a second point. These tabs enable the wearer to close the gown with only one hand, leaving the other hand free to tend to the patient.

The sleeves of the gown have gloves attached to them. This arrangement not only makes the gown and gloves easier and faster to don, but it also creates a seal between the gloves and sleeves to prevent foreign substances from entering the sleeves and coming into contact with the wearer's skin.

The complete protective covering is put on from the back. The gown comes folded in such a way, known in the medical field, that the arm holes of the sleeve are nearly exposed, covered generally by only one fold, in the back side of the package. The wearer slides his hands under the fold, puts his hands through the sleeves and into the gloves, at the same time placing the gown over the shoulders. Once the wearer has the gown over his shoulders and his arms at least partly through the sleeves, he takes the shoulder tab, detaches it from the front of the gown, to which it is secured by means of a hook-and-pile pressure fastener, and in one motion, brings it around the back of the head, over the opposite shoulder, and secures it to the front of the gown, again by means of a hook-and-pile pressure fastener. The wearer similarly takes hold of the free end of the waist tab, brings it around his back and secures it by similar hook-and-pile pressure fastener means on the opposite front side to which it is permanently secured.

DESCRIPTION OF THE PREFERRED EMBODIMENT

Figure 1:
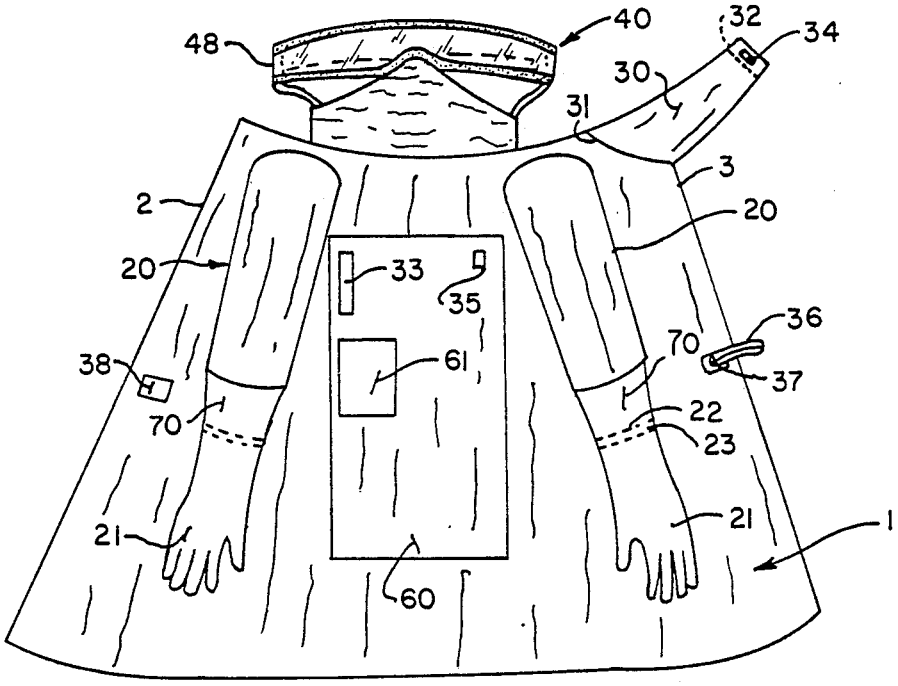
FIG. 1 is a view in front elevation of the preferred embodiment of gown of this invention spread out to show its construction.

Referring now to the Figures, and in particular to FIG. 1, reference numeral 1 indicates a preferred embodiment of protective gown of the present invention. The body of the gown 1 is a modified surgical type gown and may be similar to that of Reynolds, U.S. Pat. No. 4,395,782, or to a gown distributed by Mars White Knight, Asheville, NC. The gown 1 has sleeves 20 and two substantially vertical back flaps 2 and 3 which extend the full length of the back and meet in the center thereof when closed. The gown is preferably made from or covered with a material that is resistant to saturation of fluids that would be present at accident scenes, such as gasoline or oil, as well as to body fluids. The gown 1 differs from a standard surgical gown in that it has attached thereto gloves 21, a shoulder tab 30, a waist tab 36, and a face mask 40. It also has a plastic front panel 60 and plastic arm panels 70.

The gloves 21 are made from 1.5 millipore latex, and extend past the wrists to a point ½ to ¾ up the lower arm, depending upon the size of the wearer. The gloves 21 are attached by adhesive to the sleeves 20 of the gown 1 at the top end of the gloves 22 where glove-sleeve seals 23 are formed. The sleeve continues down inside the glove to a point just over the wrist. The sleeves 20 end in knitted cuffs (not shown), which prevent the sleeve 20 from covering the hand and hindering movement of the hand.

The shoulder tab 30 is attached to the gown 1 at the back of the neck over the left shoulder as indicated at 31. The shoulder tab 30 is of a length sufficient to come around the back of the neck and to attach to the front of the gown over the right shoulder. The free end of the shoulder tab 30 includes a first hook-and-pile fastener element 32 on one side and a second hook and pile fastener element 34 on its other side. The hook-and-pile pressure fastener patch 32 at the end of the tab 30 attaches to an opposite piece of hook-and-pile pressure fastener 33 secured to the front of the gown over a right breast pocket 61 when the garment 1 is donned. When the gown is packaged, the tab element 32 is attached to a hook-and-pile pressure fastener square 35 on the front left of the gown.

The gown 1 has in addition to the shoulder tab 30 a waist tab 36 to create a more secure closing. One end of the waist tab is permanently secured to the front left of the gown, and the other, free, end 37 of the tab 36 passes around the back of the wearer and is detachably secured by hook-and-pile pressure fastener to allow quick attachment with one hand, to a hook-and-pile pressure fastener patch 38 on the front right of the gown. Use of the waist tab is optional and is at the discretion of the wearer.

Figure 3:
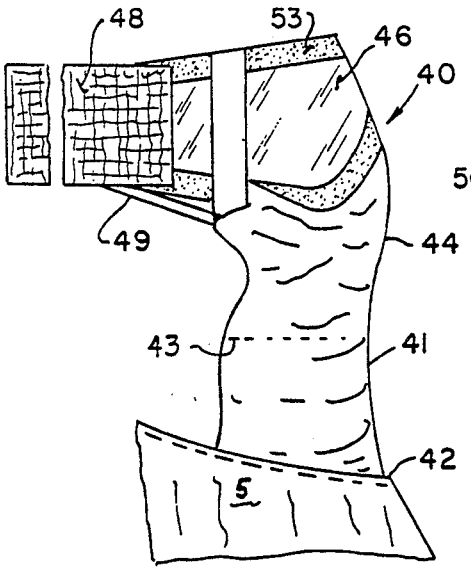
FIG. 3 is a view in side elevation of the face covering of FIG. 2.
Figure 2:
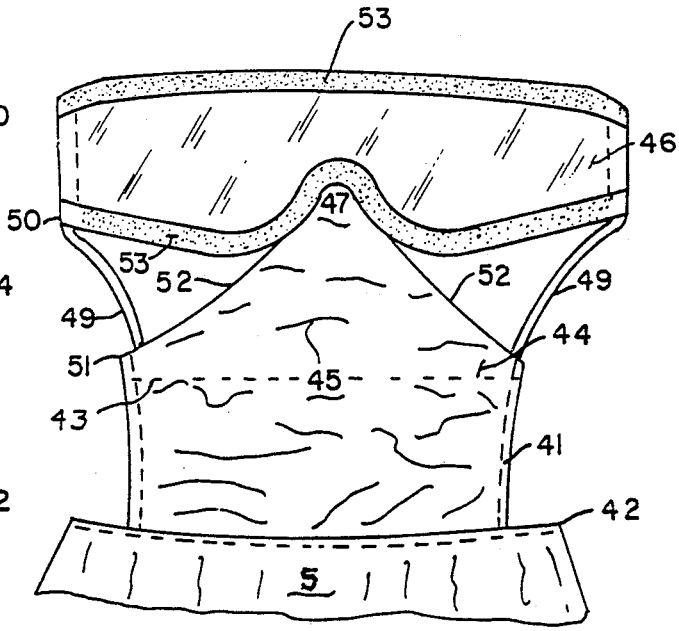
FIG. 2 is a view in front elevation of a face covering portion of the gown of FIG. 1.

As shown particularly in FIGS. 2 and 3, the full mask 40 comprises a neck protector 41 which is attached to the gown at the neck 42, a pleated surgical mask 44 attached to the top of the neck protector 41 along an attachment line 43, and an eye protector 46 attached to the surgical mask 44 at the bridge of the nose 47. The surgical mask 44 includes pleats 45 so that the wearer will not suck in the mask when breathing and to prevent moisture buildup on the mask from breathing. The eye protector has attached at the sides thereof, a head band 48 which fits around the back of the head to support the face mask 40 and to hold it over the wearer's face securely. The goggles preferably have means of forming a tight seal, as in BFD, Inc.'s antifog goggles, model 7131.

The face mask 40 has fitting means 49 made from elastic straps which extend from the side of the goggles 46 at their sides 50 down to the top corner 51 of the neck protector 41. Between these points, the straps 49 are attached to the surgical mask 44 at 52. The straps may alternatively extend the length of the mask from the tip of the surgical mask to the bottom of the neck protector. The straps 49 serve the purpose of fitting the mask better to wearers of different sizes. The straps have several inches of slack, so that it will become more taut on a person on whom the distance between the bridge of the nose and the bottom of the neck is large. Conversely, the mask will puff on one on whom this distance is not so great. This provides the face mask with a one size fits all capability, creating a secure fit for all wearers. It further provides the wearer with the ability to move his head without losing the protection the mask affords him. These straps 49 serve as further means of supporting the neck protector 41 and surgical mask 44 so that each stays in place and covers the neck and face.

The goggles 46 and the surgical mask 44 have foam gasketing 53 to give more protection to the wearer by creating a more secure seal between the wearer's face and the mask 40. On the goggles 46 the foam gasket 53 is located at the top and lower edges, and extends nearly all the way across the goggles. The BFD goggles, aforementioned, come complete with such foam gasketing. On the surgical mask 44 the foam gasketing is located only at the top of the mask, and extends nearly the full length thereof.

Figure 4:
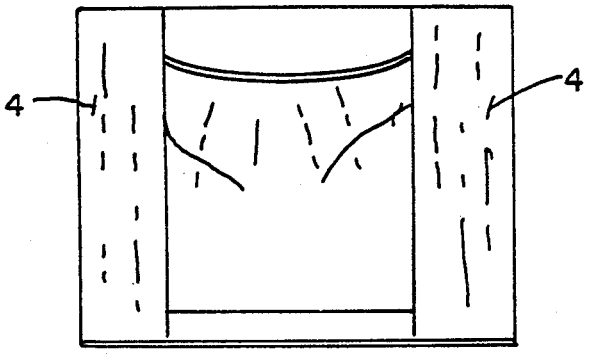
FIG. 4 is a diagramatic view of the gown of FIG. 1 when folded.
Figure 5:
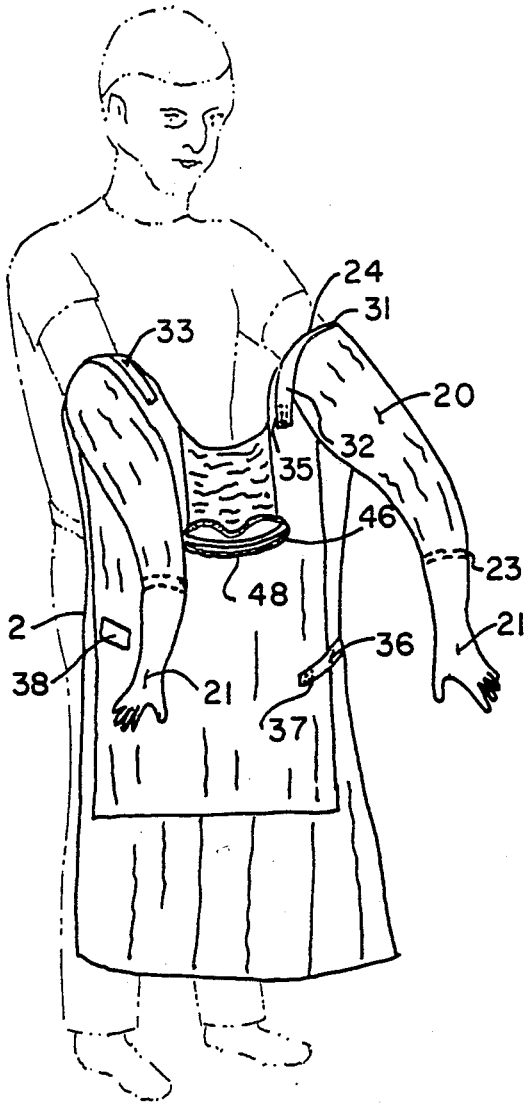
FIG. 5 is a view in perspective showing a wearer sliding his hands through the arms of the gown of FIG. 1
Figure 7:
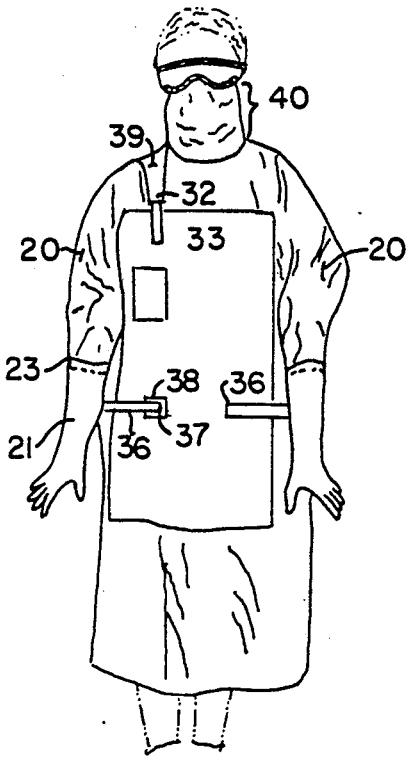
FIG. 7 is a view in front elevation showing the wearer with the gown of FIG. 1 when fully donned.
Figure 8:
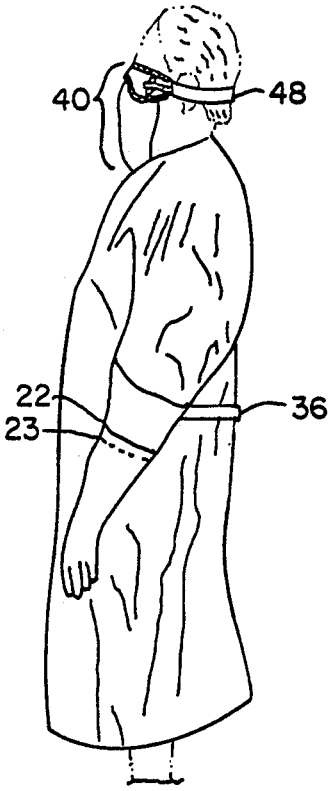
FIG. 8 is a view in side elevation of FIG. 7.
Figure 9:
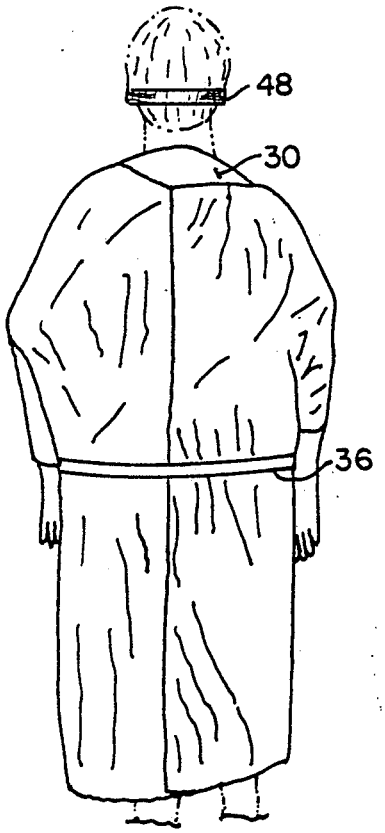
FIG. 9 is a view in rear elevation of FIG. 7.
Figure 6:
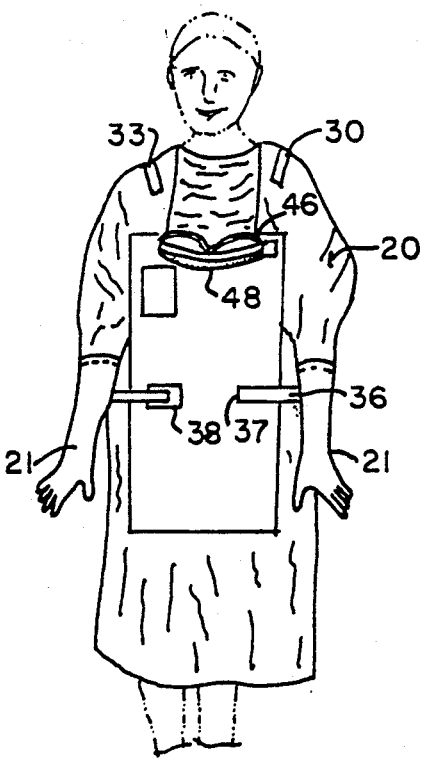
FIG. 6 is a view in perspective showing the wearer with the gown of FIG. 1 on prior to closing.

When packaged, the gown comes folded, in a manner known to the medical field, as seen in FIG. 4, such that the entrances to the sleeves are nearly exposed, generally covered by only one fold. Further, the free end of the shoulder tab 32 is detachably secured to the front left of the gown by means of hook-and-pile pressure fastener and the waist tab 36 is similarly secured. When donning the gown, the wearer slides his hands under the folds 4 and into the sleeves 20. Once the wearer has the gown over his shoulders and his hands are at least part way through the sleeves, but preferably in the gloves, the wearer takes hold of the shoulder tab 30, detaches it from its initial secured point and in one motion and preferably with one hand, swings it around the back of his neck and secures it to the hook-and-pile pressure fastener patch 33 on the front of the gown. This holds the gown closed at the top. Once the shoulder tab 13 is secured, the wearer may bring the waist tab 36 around his back and by means of hook-and-pile pressure fastener 38, secure the waist tab 36 at the front of the gown. This holds the two back flaps 2 and 3 closed, thus providing an added measure of protection to the wearer. Once the gown is securely closed, the wearer lifts the face mask up by the head band 48 and puts the head band around the head so that it will hold up the face mask 40. When the face mask is put on, the elastic straps 49 expand so that the sides of the mask are snug against the wearer's cheeks.

Numerous variations, within the scope of the appended claims, will be apparent to those skilled in the art in light of the foregoing description and accompanying drawings. For example, the plastic covering 60 may be omitted in many applications or when the gown is made from a liquid-resistant material. The neck covering and lower face covering may be formed as a single piece, having pleats similar to those in the surgical mask. These variations are merely illustrative.

We claim:

1. An emergency protective covering adapted to protect medical personnel when treating potentially infectious patients in emergency situations, for protecting the wearer's face, body, and hands with a single garment donned unaided, as a unit, by the wearer, said protective covering comprising a surgical gown with an open back, said surgical gown having sleeves and a neck portion, face protection means attached to said neck portion of said gown for covering at least the eyes, nose, and mouth of the wearer, and gloves attached to said sleeves of said gown, said face protection means comprising a. a flexible neck covering and a lower face covering, at least said lower face covering being pleated; and b. an eye covering attached to said lower face covering, said eye covering comprising means to hold said eye covering in place and to support said flexible covering substantially independent of said gown to permit free movement of said face protection means with respect to the gown.

2. The emergency protective covering of claim 1, wherein the face protection means comprise means of creating a seal with the skin of the wearer to keep out foreign substances.

3. An emergency protective covering adapted to protect medical personnel when treating potentially infectious patients in emergency situations, for protecting the wearer's face, body, and hands with a single garment donned unaided, as a unit, by the wearer, said protective covering comprising a surgical gown with an open back, said surgical gown having sleeves and a neck portion, face protection means attached to said neck portion of said gown for covering at least the eyes, nose, and mouth of the wearer, and gloves attached to said sleeves of said gown, said gown further comprising shoulder tab means having a free end and means for holding said shoulder tab means releasably attached in an open position at the front of said gown such that the wearer can with one hand, in one motion, pull said tab behind and around the head and secure said free end to the front of said gown so that it will remain closed during use.

4. The emergency protective covering of claim 3, wherein the gown further comprises a waist tab securely attached to the front of the gown, said tab having a free end which may be brought around the back of the gown by the wearer in one motion and with one hand, and attachment means on the front of the gown for the free end of the waist tab.

5. An emergency protective covering designed to protect emergency personnel when treating potentially infectious patients in emergency situations, said covering comprising a body having sleeves and an open back, tab means having a free end initially detachably secured to the front of the body in an open position such that a wearer can don the covering from the back, and attachment means on the front of said body such that the wearer can with one hand, in one motion, quickly detach said free end from said covering, pull said tab behind and around the head and secure said free end to said attachment means so that it will remain closed during use.

6. The protective covering of claim 5, wherein said covering has a waist tab permanently secured to the covering, said waist tab having a free end which the wearer brings around his back to be secured to the opposite front side so as to create a second closure.

7. A combined protective face mask and gown, said gown including a body part for covering at least the front of the upper body of a wearer, said face mask comprising a transparent eye covering, means for holding said eye covering to the head of a wearer, a pleated, flexible lower face covering attached to said eye covering, and a flexible neck covering attached to said lower face covering, said neck covering being attached to said gown; means for holding said gown to the shoulders of the wearer independent of the eye covering; and elastic fitting means on either side of said lower face covering extending from the sides of said eye covering to the top corners of said neck covering, said elastic fitting means being attached to the lower face covering to permit said face mask to fit wearers of different sizes.

8. The protective face mask and gown of claim 7, wherein said lower face covering and said neck covering are made from one piece of material.

9. The protective face mask and gown of claim 8, wherein said fitting means extend the full length of either side of said lower face and neck coverings.

* * * * *